US006344790B1

(12) United States Patent
Ochi et al.

(10) Patent No.: US 6,344,790 B1
(45) **Date of Patent: *Feb. 5, 2002**

(54) ELECTRONIC DEVICE SUCH AS A THERMISTOR AND THE LIKE WITH IMPROVED CORROSION RESISTANCE

(75) Inventors: Naoyuki Ochi; Masahiro Hirama, both of Yokoze-machi; Hiroshi Tomoto, Jouetsu; Atsushi Miyazaki, Mito; Takayuki Saito, Hitachinaka; Kaoru Uchiyama, Oomiya-machi, all of (JP)

(73) Assignees: Hitachi, Ltd., Tokyo; Hitachi Car Engineering Co., Ltd., Hitachinaka, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/907,881

(22) Filed: Aug. 11, 1997

(30) Foreign Application Priority Data

Aug. 9, 1996 (JP) ..... 8-211193

(51) Int. Cl.[7] ..... H01C 7/10; H01C 7/13

(52) U.S. Cl. ..... 338/22 SD; 338/22 R; 338/272; 338/273

(58) Field of Search ..... 338/22 SD, 22 R, 338/272, 273, 276

(56) References Cited

U.S. PATENT DOCUMENTS 4,117,589 A * 10/1978 Francis et al. ..... 29/619
4,276,536 A * 6/1981 Wisnia ..... 338/23
4,512,871 A * 4/1985 Kato et al. ..... 204/429
5,436,608 A * 7/1995 Togura ..... 338/21
5,506,071 A * 4/1996 Tanaka et al. ..... 429/181

FOREIGN PATENT DOCUMENTS

| | | |
|---|---|---|
| EP | 0 129 997 | 1/1985 |
| EP | 0 171 877 | 8/1986 |
| JP | 55-09665 | 7/1980 |
| JP | 56-103454 | 8/1981 |
| JP | 63-067761 | 3/1988 |
| JP | 02-164004 | * 12/1988 |
| JP | 07-312301 | 11/1995 |

* cited by examiner

*Primary Examiner*—Karl D. Easthom
*Assistant Examiner*—Kyung S. Lee
(74) *Attorney, Agent, or Firm*—Crowell & Moring LLP

(57) ABSTRACT

Corrosion resistant material is used for lead wires of the thermistor, and an exposed portion of electrodes of the thermistor and a portion surrounding a weld portion of the lead wires are coated with corrosion resistant material. Since the lead wires themselves are made of corrosion resistant material, no corrosion occurs in the welding portion and a cut working portion. Further, the lead wires and the exposed portion of the electrodes are coated with corrosion resistant material. Thereby an electronic device having extremely high corrosion resistivity and hence high durability and reliability is produced, with the result that the electronic device can be used for a long period without corrosion under the heavily corrosive environment, such as sulfur dioxide gas atmosphere.

3 Claims, 2 Drawing Sheets

ELECTRONIC DEVICE SUCH AS A THERMISTOR AND THE LIKE WITH IMPROVED CORROSION RESISTANCE

BACKGROUND OF THE INVENTION

This application claims the priority of 8-211193, the disclosure of which is expressly incorporated by reference herein.

The present invention relates to an electronic device, and more particularly to an electronic device structure with excellent corrosion resistivity suitable for an electronic device with lead wires used under the heavily corrosive environment, such as a temperature sensitive resistor for measuring the temperature of intake air in an automobile.

Referring to FIG. 1, a conventional temperature sensitive resistor, i.e., a thermistor, typical of an electronic device with lead wires of the type to which the present invention is addressed will be described below. In particular, a glass-sealed thermistor of an axial type (a diode type) is used as an example. The known thermistor is constructed by putting thermistor element 2 in glass tube 1, which is hermetically sealed by sealing electrodes 3A, 3B. The thermistor element 2 is sandwiched by the electrodes 3A, 3B to maintain the electric contact therebetween. Further, lead wires 4A, 4B are electrically attached to the electrodes 3A, 3B, respectively.

Usually, a dumet wire (JIS H4541) has been used for the sealing electrodes 3A, 3B in such a glass-sealed type thermistor as described above. FIG. 2 shows a sectional view of an example of the dumet wire.

A dumet wire is constructed by coating core wire 11 made of iron-nickel alloy by copper 12 as an intermediate layer, which is further covered by surface layer 13 of cuprous oxide ($Cu_2O$) or borate ($Cu_2O$—$Na_2B_4O_7$). The core 11 of a dumet wire is made of iron-nickel alloy in order to bring the thermal expansion coefficient closer to that of glass, whereas the surface layer thereof is made of cuprous oxide for the purpose of the good melting-adhesiveness with glass. Since the sealing electrode 3A, 3B is made by cutting such a dumet wire in an appropriate length, iron-nickel alloy as core material is exposed to the atmosphere at the end surface 3*a*. 3*b*.

Further, the lead wire 4A, 4B, as an example thereof being shown in FIG. 3, is formed by coating the surface of core wire 15 made of dumet, iron or iron-nickel alloy with copper 14.

Metallic portions of the glass-sealed type thermistor, i.e., the outer end surfaces 3*a*, 3*b* of the sealing electrodes 3A, 3B and the surfaces of the lead wires 4A, 4B, are plated by solder so as to solder the thermistor onto a substrate. Further, nickeling can also be used to attach the thermistor to the substrate by spot welding or the like.

As described above, the core of the dumet wire made of iron-nickel alloy is exposed to the atmosphere at the end surfaces 3*a*, 3*b*. However, the corrosion resistivity of the end surface 3*a*, 3*b* can be improved by solder-plating or nickeling.

A thermistor of this kind is often used in a corrosive environment, such as a temperature sensitive resistor for measuring the temperature of intake air in an automobile. In such a case, the thermistor is required to have sufficiently high corrosion resistivity.

However, a conventional glass-sealed type thermistor as mentioned above does not have sufficiently high corrosion resistivity and hence has a disadvantage that corrosion occurs when it is used in a heavily corrosive environment, such as sulfur dioxide gas atmosphere.

In other words, a thermistor, which has solder plating to cover its metallic portions, can not have sufficiently high corrosion resistivity. Compared with a soldered thermistor, a thermistor which has nickeling for the same purpose can be much improved in corrosion resistivity.

Even with the later thermistor, however, corrosion resistivity is less than desirable. This is because when a lead wire is cut for the length adjustment thereof, its core of easily corrosible iron-nickel alloy or iron appears at the cut surface which is exposed to the corrosive atmosphere and from which corrosion will begin.

Further, in the case of using the spot-welding, a layer of nickel plated on a lead wire is melted by welding heat, and the core of iron-nickel alloy or iron is exposed to the corrosive atmosphere and continues to be corroded from such an exposed portion.

SUMMARY OF THE INVENTION

An object of the present invention is to provide a structure of an electronic device, such as a thermistor, having extremely high corrosion resistivity.

A structure of an electronic device according to the present invention comprises an element with a desired electronic characteristic, electrodes electrically connected to the element, inorganic insulator for sealing or coating at least part of the element and the electrodes, and lead wires provided for the electrical connection with the electrodes, wherein the lead wires are made of corrosion resistant material and further at least a portion surrounding a joint of the lead wires and the electrodes is coated with corrosion resistant material.

Since in the present invention, the lead wires themselves are made of corrosion resistant material, there occurs no corrosion in a welding portion and a cut portion. Further, since the lead wires and the exposed portion of the electrodes are coated with corrosion resistant material, a structure of an electronic device having the extremely high corrosion resistivity, and hence high durability as well as high reliability, is provided. As a result, an electronic device with a structure according to the present invention can be used for a long period without corrosion in a heavily corrosive environment, such as sulfur dioxide gas atmosphere.

In one of the embodiments of the present invention, an axial type of a glass-sealed thermistor may be constructed in the following manner; namely, first of all, cylindrical electrodes made of dumet wire are welded with lead wires made of nickel. Then, a semiconductor thermistor element and the cylindrical electrodes are put in a glass tube in such a manner that the electrodes hermetically seal both ends of the glass tube. Further, nickeling is performed on an exposed portion of the electrodes and the lead wires, as well as the welded portion of the lead wires with the electrodes.

In another embodiment of the present invention, a linear type of a temperature sensitive resistor with lead wires may be constructed as follows; namely, at first, a temperature sensitive element is made by forming a metallic film on the surface of a cylindrical alumina bobbin. Cap electrodes made of iron-nickel alloy are fitted by pressure to both ends of the temperature sensitive element as formed above. Then, lead wires made of nickel are welded to the cap electrodes. Part of the temperature sensitive element and the electrodes are coated with glass, and nickeling is performed on an exposed portion of the cap electrodes and the lead wires, as well as the welded portion of the lead wires with the cap electrodes.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
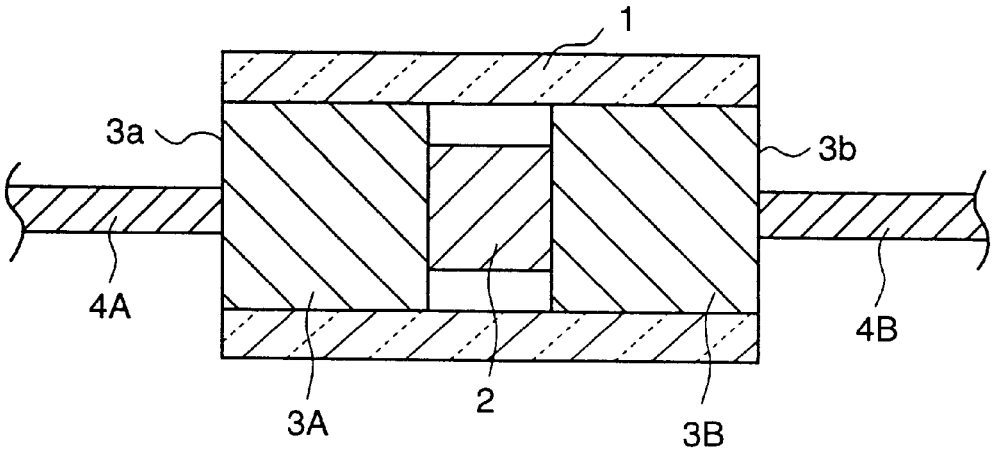
FIG.1 PRIOR ART
FIG. 1 is a cross-sectional view of a conventional glass-sealed type thermistor.
Figure 2:
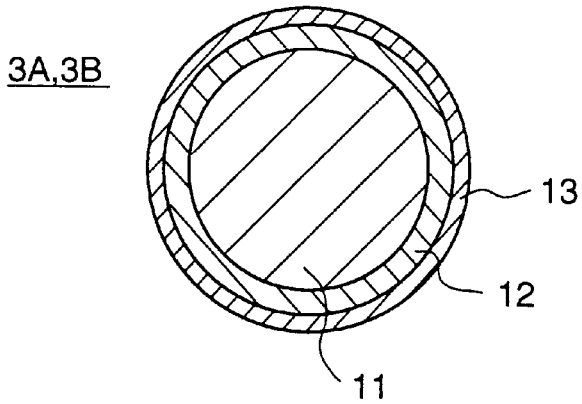
FIG. 2 is a cross-sectional view of an example of a dumet wire used as a sealing electrode in the glass-sealed type thermistor.
Figure 3:
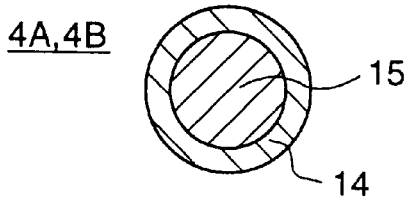
FIG. 3 is a cross-sectional view of an example of a lead wire used in the glass-sealed type thermistor.
Figure 4:
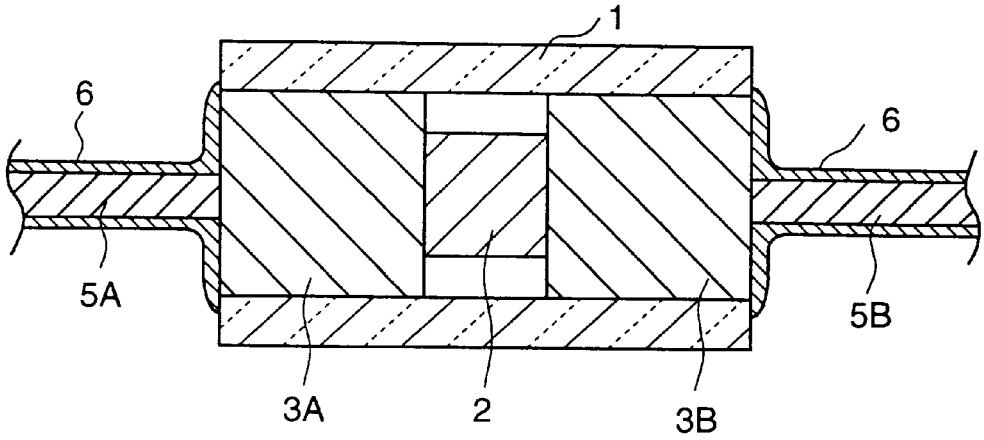
FIG. 4 is a cross-sectional view of a glass-sealed type thermistor in accordance with an embodiment of the present invention.

FIG. 4 uses the same reference numerals or symbols as those used in FIG. 1 to indicate the same parts and functionality.

As shown in the drawing, the glass-sealed type thermistor is constructed as follows. Namely, the glass tube 1 has the thermistor element 2 therein. Both ends of the glass tube 1 are hermetically sealed by the sealing electrodes 3A, 3B, to which nickel lead wires 5A, 5B are attached. Nickel member 6 is plated on metallic portions of an assembly as described above, i.e., outer end surface of the electrodes 3A, 3B and surface of the lead wires 5A, 5B.

In this embodiment, it is preferable to use dumet wire for the sealing electrodes 3A, 3B in the same manner as that conventionally used. Further, there is no limitation in the length and diameter of the electrode 3A, 3B.

Also the glass tube 1 can be formed by a glass tube made of $SiO_2$—PbO—$K_2O$ or the like in a conventional manner. Thickness of the glass tube 1 depends on the size of the thermistor element 2, but is generally 0.3~1.0 mm. Preferably, an inner diameter of the glass tube 1 is 1~1.8 times as large as the diameter of the thermistor element 2 to be inserted therein, and a length thereof is 3~50 times as large as the thickness of the thermistor element 2.

The thermistor element 2 is a thermistor ceramic with electrodes made of Ag, Pd or the like on both side thereof. The size of the thermistor element 2 is usually 0.35~0.6 $mm^2$.

Preferably, the nickel lead wires 5A, 5B are 0.3~0.5 mm in diameter. Further, the thickness of the nickeling is preferably 2~10 $\mu$m, since it is difficult to improve the corrosion resistivity if it is much thinner than the above-stated thickness and it is uneconomical if it is much thicker than that stated thickness.

In the present invention, there is no need to nickel the lead wire, since it is made by a nickel wire. If, however, the end surface of the sealing electrodes 3A, 3B is nickeled, the lead wires 5A, 5B can also be nickeled as a result.

The inventors tested the above-described glass-sealed type thermistor spot-welded onto a substrate and used in a sulfur dioxide gas atmosphere for a long period. No occurrence of corrosion could be found in that test, however.

Figure 5:
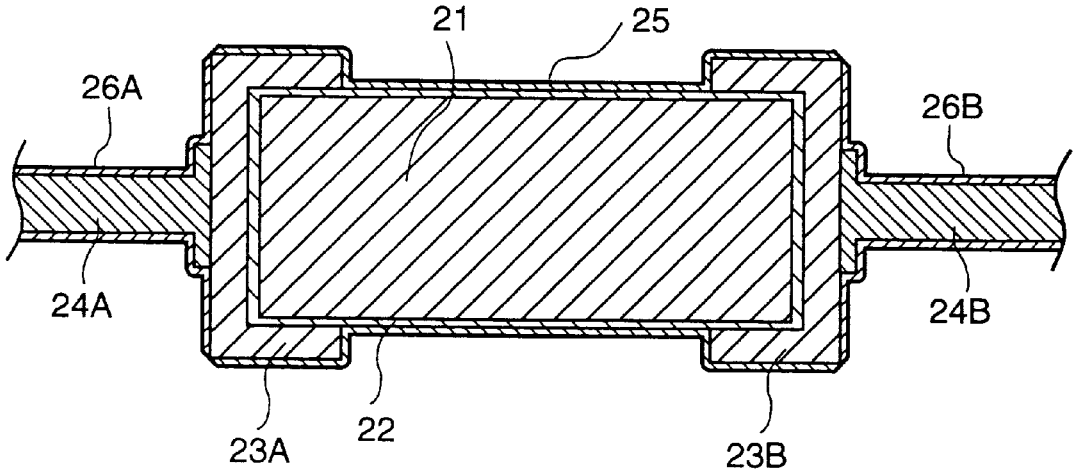
FIG. 5 is a cross-sectional view of a glass-sealed type thermistor in accordance with another embodiment of the present invention.

In the linear type of a temperature sensitive resistor shown in FIG. 5, a temperature sensitive element according to this embodiment is constructed as follows. Thin platinum film 22 is formed by barrel spatter on the surface of a solid cylindrical bobbin 21 made of alumina having a diameter of nearly 1 mm. The bobbin 21 with the platinum film 22 is further treated by heating.

Cap electrodes 23A, 23B made of iron-nickel alloy are fitted by pressure on both ends of the temperature sensitive element, to which electrodes nickel lead wires 24A, 24B having a diameter of 0.3~0.5 mm are welded.

Then, adjustment of resistance is performed by laser trimming of the thin platinum film 22. Further, nickel plating 26A, 26B having the thickness of 2~10 $\mu$m is performed on an exposed portion of the electrodes 23A, 23B and the surface of the lead wires 24A, 24B, after coating the thin platinum film portion and part of the cap electrodes 23A, 23B with glass 25.

The inventors carried out a test on this thermistor as they did on the FIG. 4 embodiment. As a result, no occurrence of corrosion could be found in the FIG. 5 thermistor.

As described above, with the structure of the electronic device in accordance with the present invention, a temperature sensitive resistor with lead wires is provided having extremely high corrosion resistivity and hence high durability and reliability. As a result, the electronic device according to the present invention can be used for a long period without corrosion in a heavily corrosive environment, such as sulfur dioxide gas atmosphere.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electronic device, comprising:

an element having a temperature-dependent property;

a pair of electrodes comprising dumet for making electrical connection with said element;

a glass member covering said element and a part of said electrodes so as to hermetically seal said element between said pair of electrodes;

a pair of lead wires made of corrosion resistant metal, each being electrically joined by welding to corresponding one of said pair of electrodes at a portion thereof non-covered by said glass member; and a corrosion resistant metal plating separately formed subsequent to the lead wire joining on the surfaces of the non-covered portion of said electrodes except for the joint portions thereof with said lead wires and on the surfaces of said lead wires whereby the corrosion resistance of the metal plating is higher than a corrosion resistance of the dumet electrodes.

2. The electronic device according to claim 1, wherein said lead wire is made of nickel, and nickel plating is provided at least on the portion surrounding the joint of said lead wires and said electrodes.

3. The electronic device according to claim 1, wherein said element is a thermistor made of a semiconductor material having a temperature dependent characteristic.

* * * * *